US008740174B2

(12) United States Patent
Juda et al.

(10) Patent No.: US 8,740,174 B2
(45) Date of Patent: Jun. 3, 2014

(54) DUAL-DIRECTION RAM-TYPE BLOWOUT PREVENTER SEAL

(75) Inventors: John David Juda, Cypress, TX (US); Eugene Charles Chauviere, III, Cypress, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 1513 days.

(21) Appl. No.: 11/609,585

(22) Filed: Dec. 12, 2006

(65) Prior Publication Data

US 2008/0135791 A1 Jun. 12, 2008

(51) Int. Cl.
*E21B 33/06* (2006.01)

(52) U.S. Cl.
USPC ..... 251/1.3; 251/1.1; 251/172

(58) Field of Classification Search
USPC ..... 251/1.1, 1.3, 170, 172, 174, 197, 1.2
See application file for complete search history.

(56) References Cited

U.S. PATENT DOCUMENTS

| | | | | |
|---|---|---|---|---|
| 1,713,364 | A * | 5/1929 | Arbon | 251/1.3 |
| 3,078,865 | A * | 2/1963 | Estes et al. | 251/328 |
| 3,791,616 | A * | 2/1974 | Le Rouax | 251/1.3 |
| 4,192,483 | A * | 3/1980 | Combes | 251/172 |
| 4,236,692 | A | 12/1980 | Williamson | |
| 4,240,642 | A | 12/1980 | Roussin | |
| 4,320,890 | A | 3/1982 | Meyer et al. | |
| 4,364,544 | A * | 12/1982 | Kim | 251/172 |
| 4,392,657 | A | 7/1983 | Roley | |
| 4,444,404 | A * | 4/1984 | Parks, Jr. | 251/1.2 |
| 4,471,943 | A | 9/1984 | Nelson | |
| 4,515,347 | A | 5/1985 | Sitton et al. | |
| 4,572,298 | A * | 2/1986 | Weston | 251/327 |
| 4,625,942 | A * | 12/1986 | Nelson | 251/327 |
| 4,655,431 | A | 4/1987 | Helfer et al. | |
| 5,211,373 | A | 5/1993 | Baker | |
| 5,320,327 | A * | 6/1994 | Beson | 251/172 |
| 5,445,359 | A * | 8/1995 | Beson | 251/159 |
| 6,124,619 | A | 9/2000 | Maeda et al. | |
| 6,164,619 | A | 12/2000 | Van Winkle et al. | |
| 6,554,247 | B2 | 4/2003 | Berckenhoff et al. | |
| 6,719,262 | B2 | 4/2004 | Whitby et al. | |
| 2004/0079909 | A1 | 4/2004 | Foster | |
| 2004/0258470 | A1 | 12/2004 | Hemphill et al. | |
| 2006/0090899 | A1 | 5/2006 | Gass | |

FOREIGN PATENT DOCUMENTS

WO 2008073874 A1 6/2008

OTHER PUBLICATIONS

Examination Report for Application No. GCC/P/2007/9722 with mailing date of Oct. 5, 2010.

* cited by examiner

*Primary Examiner* — John K Fristoe, Jr.
*Assistant Examiner* — Andrew J Rost
(74) *Attorney, Agent, or Firm* — Bracewell & Giuliani LLP

(57) ABSTRACT

A ram-type blowout preventer and method of actuating thereof. The ram-type blowout preventer includes a seal carrier disposed about a vertical bore between the body and adjacent to the horizontal bore. The seal carrier is configured to be thrust into sealing engagement with at least one of a pair of ram blocks of the ram-type blowout preventer by fluid pressure above the ram blocks and a sealing device forms a seal between the body and the seal carrier.

19 Claims, 5 Drawing Sheets

DUAL-DIRECTION RAM-TYPE BLOWOUT PREVENTER SEAL

BACKGROUND

1. Field of the Disclosure

Embodiments disclosed herein generally relate to blowout preventers used in the oil and gas industry. Specifically, selected embodiments relate to an improved seal carrier for use in ram-type blowout preventers, in which the seal carrier is configured to be displaced along an axis of the ram-type blowout preventer.

2. Background Art

Well control is an important aspect of oil and gas exploration. When drilling a well, for example, safety devices must be put in place to prevent injury to personnel and damage to equipment resulting from unexpected events associated with the drilling activities.

Drilling wells involves penetrating a variety of subsurface geologic structures, or "formations." Occasionally, a wellbore will penetrate a formation having a formation pressure substantially higher than the pressure maintained in the wellbore When this occurs, the well is said to have "taken a kick." The pressure increase associated with a kick is generally produced by an influx of formation fluids (which may be a liquid, a gas, or a combination thereof) into the wellbore. The relatively high-pressure kick tends to propagate upwards from a point of entry in the wellbore towards the surface (from a high-pressure region to a low-pressure region). If the kick is allowed to reach the surface, drilling fluid, well tools, and other drilling structures may be blown out of the wellbore. Such "blowouts" may result in catastrophic destruction of the drilling equipment (including, for example, the drilling rig) and substantial injury or death of rig personnel.

Because of the risk of blowouts, devices known as blowout preventers ("BOPs") are installed above the wellhead at the surface or on the sea floor in deep water drilling arrangements to effectively seal a wellbore until active measures can be taken to control the kick. There are several types of blowout preventers, the most common of which are annular blowout preventers (including spherical blowout preventers) and ram-type blowout preventers. Blowout preventers may be activated so that kicks are adequately controlled and "circulated out" of the system. In deep water drilling, BOPs are conventionally used in an assembly called a "subsea BOP stack", or simply a "subsea stack", so-called because a number of BOP are "stacked-up" (that is, joined together) in an assembly, commonly with 4, 5, or 6 ram-type BOPs stacked-up below one or two annular BOPs. The large number of BOPs in a subsea stack affords redundancy which, for example, may allow the stack to remain on the seabed for an extended period.

Referring initially to FIG. 1, a schematic of a subsea BOP stack 10 is shown Subsea BOP stack 10 includes a lower double ram BOP assembly 11, a middle double ram BOP assembly 12, and an upper double ram BOP assembly 13. Furthermore, subsea BOP stack 10 includes spools 14 and an annular BOP 15. Each double ram assembly comprises two ram BOPs (or "cavities") in a single body; consequently this stack comprises the equivalent of six conventional "single" ram BOPs and would be said to "have six ram cavities".

Referring now to FIG. 2, an example of a typical conventional ram-type blowout preventer 100 is shown. Ram-type BOP 100 includes a BOP body 102 having a vertical bore 104 (i.e., the "wellbore") and a horizontal bore 106. Vertical bore 104 is disposed about a vertical axis 105, and horizontal bore 106 is disposed about an axis 107 substantially perpendicular to axis 105. A joint of pipe 111 is shown disposed in vertical bore 104. Ram-type blowout preventer 100 further includes ram blocks 108 disposed within horizontal bore 106 on opposite sides, attached to piston actuated rods 112, and bonnets 110 which may be removably secured to BOP body 102 to enable removal of bonnets 110 for maintenance.

When ram-type blowout preventer 100 is actuated, ram blocks 108 displace along horizontal axis 107 toward vertical bore 104. Rams blocks 108 may either be pipe rams (shown) or variable bore rams, shear rams, blind rams, or any other known to those having ordinary skill in the art. Pipe and variable bore rams, when activated, move to engage and surround drillpipe and/or well tools to seal the wellbore. In contrast, shear rams engage and physically shear any wireline, drillpipe, and/or well tools in vertical bore 104, whereas blind rams close vertical bore 104 when no obstructions are present. More discussion of ram blowout preventers may be found in U.S. Pat. No. 6,554,247, issued to Berckenhoff, assigned to the assignee of the present invention, and incorporated herein by reference in its entirety.

As with any tool used in drilling oil and gas wells, blowout preventers must be sealed and secured to prevent potential hazard to the surrounding environment and personnel. For example, ram-type blowout preventers may include high-pressure seals between the bonnets and the body of the blowout preventer to prevent leakage of fluids. In many instances, the high-pressure seals are elastomeric seals and should be checked regularly to ensure that the elastomeric components have not been cut, permanently deformed, or deteriorated by, for example, a chemical reaction with the drilling fluid in the wellbore.

Referring still to FIG. 2, ram-type blowout preventer 100 includes top seals 116 disposed within grooves 118 of ram blocks 108, which are sealingly connected to front seals (or "ram packers") 109. In the case of pipe rams, when ram blocks 108 are closed as shown, the combination of the top seals 116 (which seal between the top of ram blocks 108 and the top of horizontal bore 106), and the front seals 109 (which seal completely around pipe in the vertical bore 104) completes the sealing of the annulus between the pipe 111 and the vertical bore 104. In the case of shear rams and blind rams, when ram blocks 108 are closed, the front seals 109 seal against one another rather than an object in the wellbore, and the combination of the top seals 116 and the front seals 109 completes the sealing-off of the open wellbore, Conventionally, ram blocks 108 have a pressure equalization path in the form of a groove 101 (sometimes called a "mud slot") machined into the bottom surface of the ram block to communicate fluid pressure between the vertical bore 104 below the front seals 109 and the respective volumes of the horizontal bore 106 behind the ram blocks. Thus each ram block 108 may be displaced back and forth in the horizontal bore 106 without having to work against fluid pressure differentials between the volume behind the ram blocks 108 and the vertical bore 104 below the front seals 109. Those skilled in the art will of course recognize that fluid pressure communication for pressure equalization between the vertical bore 109 and the volumes behind the ram blocks 108 may be accomplished by other means besides a machined groove in the bottom of the ram blocks 108, such as drilled passageways in the ram blocks, a milled slot in the bottom of the horizontal bore 106, or even a conduit external to the housing 102, or the like.

Referring now to FIG. 3, an enlarged cross-sectional view of a top seal wear plate 120 of a ram BOP is shown. Because the top surface of horizontal bore 106 may wear with repeated use of the ram BOP, modem ram BOPs may be fitted with replaceable top seal wear plates to avoid expensive repair of the horizontal bore 106. Top seal wear plate 120 is immovably secured to housing 102 with, for example, bolts 122 and collet-type inserts 122A, and includes a sleeve portion 120A and a flange portion 120B extending radially outward with respect to wellbore axis 105. Additionally, as shown, top seal wear plate 120 is adjacent to ram block 108 and seals against housing 102 to prevent, in conjunction with top seal 116, leakage between housing 102 and ram blocks 108. Typically, an o-ring 124 is disposed in a groove 126 of flange portion 120B of top seal plate 120 to sealingly engage (as a face seal) against housing 102 and prevent leakage of high-pressure fluids between housing 102 and seal carrier 120.

Since the primary function of ram-type BOPs is to prevent the escape of fluids from the wellbore, many ram-type BOPs only seal in a single direction. Thus, a ram-type BOP may only seal to isolate pressurized fluids from the wellbore to the environment and will not typically include a bidirectional seal; capable of sealing against a differential pressure from above the BOP.

For example, when ram blocks 108 are engaged with one another and sealing against high-pressure fluids from above, the high-pressure fluids may act upon the top surface of ram blocks 108 and urge them downward. Such urging may cause ram blocks 108 to move downward and out of sealing engagement with the top of the horizontal bore 106 (or alternately, in a ram BOP so equipped, with seal carrier 120).

Formerly, deploying a ram-type BOP having a single direction seal was not considered to be a shortcoming, as there was no reason for a BOP to seal against pressure from above. However, it is now common in deepwater drilling installations for regulatory agencies (e.g., the Minerals Management Service ("MMS"), of the United States Department of the Interior, which regulates offshore drilling for oil and gas in U.S. territorial waters) to require periodic testing of the integrity of individual ram BOPs against wellbore pressures while the subsea stack is located on the seabed.

Previously, such in situ BOP testing may have been accomplished through one of two test methods. In a first test method, a test tool is lowered through the subsea BOP stack on a string of pipe, and anchored below the lowest BOP in the stack. The test tool is actuated to seal off the wellbore at that point (as, for example, by inflating an inflatable packer), and a BOP to be tested is closed. Then, fluid pressure is communicated into the annular space around the pipe above the test tool and below the BOP being tested. After testing, the pipe string and test tool are withdrawn from the wellbore, and normal drilling operations can be resumed.

However, such a method may be extremely costly in terms of rig time. In an alternative test method, the subsea BOP stack may include an additional ram BOP installed in an inverted operating position at the bottom of the subsea BOP stack. Thus, the inverted BOP may seal against test pressure introduced thereabove. However, in placing the additional BOP in an inverted position at the bottom of a subsea BOP stack, the additional ram "cavity" may will not seal against wellbore pressure and thus may not be used as a regular BOP during operations. Furthermore, the additional BOP may also increase the height, weight and cost of a subsea BOP stack.

Consequently, it may be advantageous to have a ram BOP having the ability to seal in both directions on the seabed so that the BOP stack may be tested without running a dedicated test tool into the well. Furthermore, such a dual direction ram BOP will allow the BOP stack to be tested without requiring a dedicated inverted cavity for testing purposes. Further, because of the large number of subsea BOP stacks in existence, it may also be advantageous to have an inexpensive apparatus and method to modify existing ram-type BOPs so they could seal in both directions.

One device currently capable of effecting a bi-directional seal of a bore or conduit, for example in a gate or ball valve, involves separate seals (either metal-to-metal seals or deformable seals) on either side of a movable pressure barrier, whereby each seal acts independently of the other to seal-off pressure from one direction or the other.

However, ram BOPs attempting this "double-seal" approach may disadvantageously trap pressurized fluid behind the ram block, thereby effectively hydraulically locking the ram block. Additionally, the "bottom" sealing mechanism may add complexity and manufacturing expense. Furthermore, because the heavy weight of the ram blocks and the abrasive nature of the wellbore fluid, such a on a ram BOP may have limited working life.

A ram BOP having bi-directional sealing rains is disclosed in U.S. Pat. No. 4,655,431, issued to Helfer, et al, and incorporated by reference herein in its entirety. The ram BOP of Heifer comprises circumferential seals around the ram blocks wherein passages within the ram blocks between the face and rear of the ram blocks, both above and below the front seal, and valve means within the ram blocks allow flow through the passages only from the front to the rear of the ram block. Such a design is alleged to hold pressure equally from either direction.

Additionally, a ram BOP having bidirectional sealing rams is disclosed by U.S. Pat. No. 6,124,619, issued to Van Winkle, et al, and incorporated herein by reference in its entirety. In lieu of conventional seals, the ram BOP of Van Winkle includes ram block seals which go all the way around the ram block to seal the space behind the rams. In addition, a mechanism is provided to selectively connect the volume behind the rams with the more highly pressurized wellbore volume adjacent to the rams (either above or below). The connection made is free-flowing in both directions thereby allowing for evacuation and fluctuations with changes in wellbore pressure.

Furthermore, a BOP having bidirectional sealing rams is taught is U.S. Pat. No. 6,719,262, issued to Whitby, et al and incorporated herein by reference in its entirety. This BOP of the Whitby patent includes top seals and bottom seal and, in order to mitigate the issues of fluid trapped behind the ram blocks, includes two fluid communication systems. The first communication system is a selectively operable system to equalize the pressure behind the back of each ram with the fluid pressure below the ram packers. The second communication system includes a selectively operable fluid communications system for equalizing fluid pressure between the back of each ram with the fluid pressure above the ram packers. As such, each selectively operable fluid control system includes a control unit connected to it for such "selective" operation.

All prior-art solutions rely on completely sealing-off the ram block within the horizontal bore and equalizing the pressure differential between the wellbore (above or below the ram blocks) and the volumes behind the ram blocks. These systems are relatively complicated and expensive, the pressure balancing passageways may be prone to plugging (e.g., by drilled cuttings in the drilling mud), and failure of certain pressure-equalizing valve components may provide an open conduit from the wellbore below the ram blocks to the wellbore above the ram blocks. More critically, if the pressure-equalization mechanisms fail (whether, for example, by plugged passageways or the failure of a valving component) while operating in a subsea stack, the cessation of drilling operations, killing the well, and pulling the entire subsea stack to the surface for repairs would likely be required. Therefore, it would be desirable to have a bidirectional sealing ram BOP which does not require pressure equalization passages or valving. Additionally, it would also be desirable to have a ram BOP capable of sealing against bi-directional pressure using the existing ram block seals of "legacy" ram BOPs.

SUMMARY OF INVENTION

In one aspect, embodiments disclosed herein relate to a ram-type blowout preventer. The ram-type blowout preventer comprises a body, a vertical bore through the body, a horizontal bore through the body intersecting the vertical bore, and a pair of ram blocks disposed in the horizontal bore on opposite sides of the body, in which the ram blocks are adapted for controlled lateral movement to and from the vertical bore. The ram-type blowout preventer further includes a seal carrier disposed about the vertical bore between the BOP body and adjacent to the horizontal bore, in which the seal carrier is configured to be displaced along an axis of the vertical bore. The ram-type blowout preventer further includes a sealing device positioned between the body and the seal carrier.

In another aspect, embodiments disclosed herein relate to a ram-type blowout preventer. The ram-type blowout preventer includes a body, a vertical bore through the body, a horizontal bore through the body intersecting the vertical bore, and a pair of ram blocks disposed in the horizontal bore on opposite sides of the body, in which the ram blocks are adapted for controlled lateral movement to and from the vertical bore. The ram-type blowout preventer further includes a seal carrier disposed at the intersection of the vertical bore and the horizontal bore, in which the seal carrier is configured to be displaced along an axis of the vertical bore and to be sealingly engaged with a top seal of the at least one of the pair of ram blocks. The ram-type blowout preventer further includes a sealing device positioned between the body and the seal carrier.

Further, in another aspect, embodiments disclosed herein relate to a ram-type blowout preventer. The ram-type blowout preventer includes a body, a vertical bore through the body, a horizontal bore through the body intersecting the vertical bore, and a pair of ram blocks disposed in the horizontal bore on opposite sides of the body, in which the ram blocks are adapted for controlled lateral movement to and from the vertical bore. The ram-type blowout preventer further includes a seal carrier disposed at the intersection of the vertical bore and the horizontal bore, in which the seal carrier is configured to be thrust into sealing engagement with at least one of the pair of ram blocks by fluid pressure above the ram blocks. The ram-type blowout preventer further includes a sealing device positioned between the body and the seal carrier.

Further, in yet another aspect, embodiments disclosed herein relate to a method of actuating a ram-type blowout preventer. The method includes sealing a pair of ram blocks against one another proximate a wellbore axis and sealingly engaging a seal carrier with the pair of ram assemblies from fluid pressure acting upon the ram assemblies. The seal carrier is configured to be sealingly displaced along the wellbore axis.

Other aspects and advantages of the embodiments disclosed herein will be apparent from the following description and the appended claims.

DETAILED DESCRIPTION

In one aspect, embodiments disclosed herein relate to a ram-type blowout preventer with an improved seal carrier. In another aspect, embodiments disclosed herein relate to a ram-type blowout preventer with a seal carrier which is configured to be displaced along an axis of a vertical bore of the ram-type blowout preventer. In another aspect, embodiments disclosed herein relate to a ram-type blowout preventer with a seal carrier which is configured to be thrust into sealing engagement with a top seal of a ram assembly of a ram-type blowout preventer.

Figure 1:
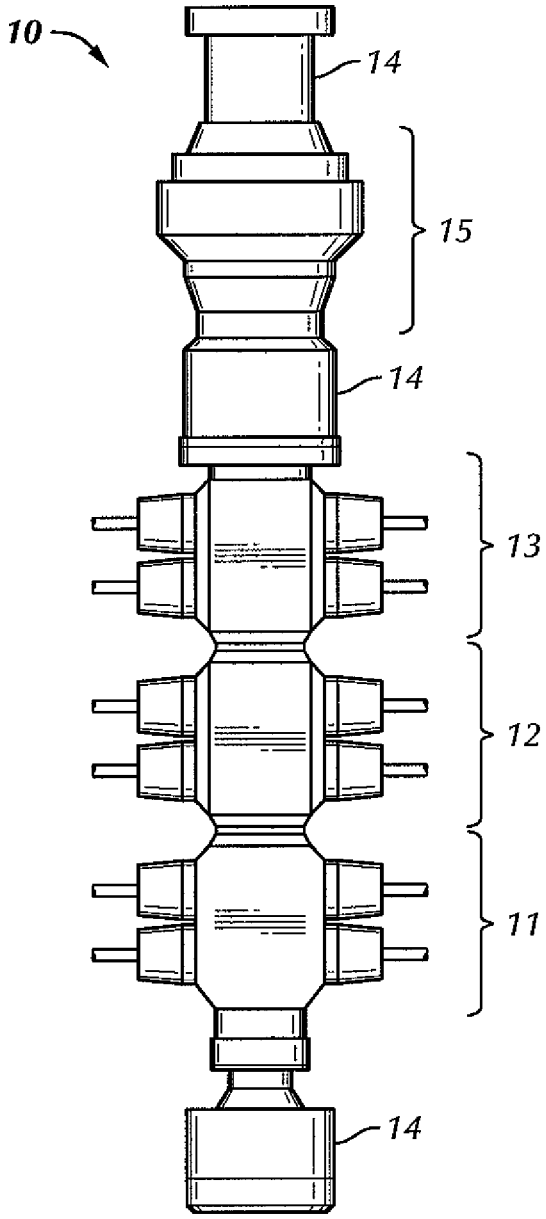
FIG. 1 is a schematic drawing of a subsea BOP stack.
Figure 2:
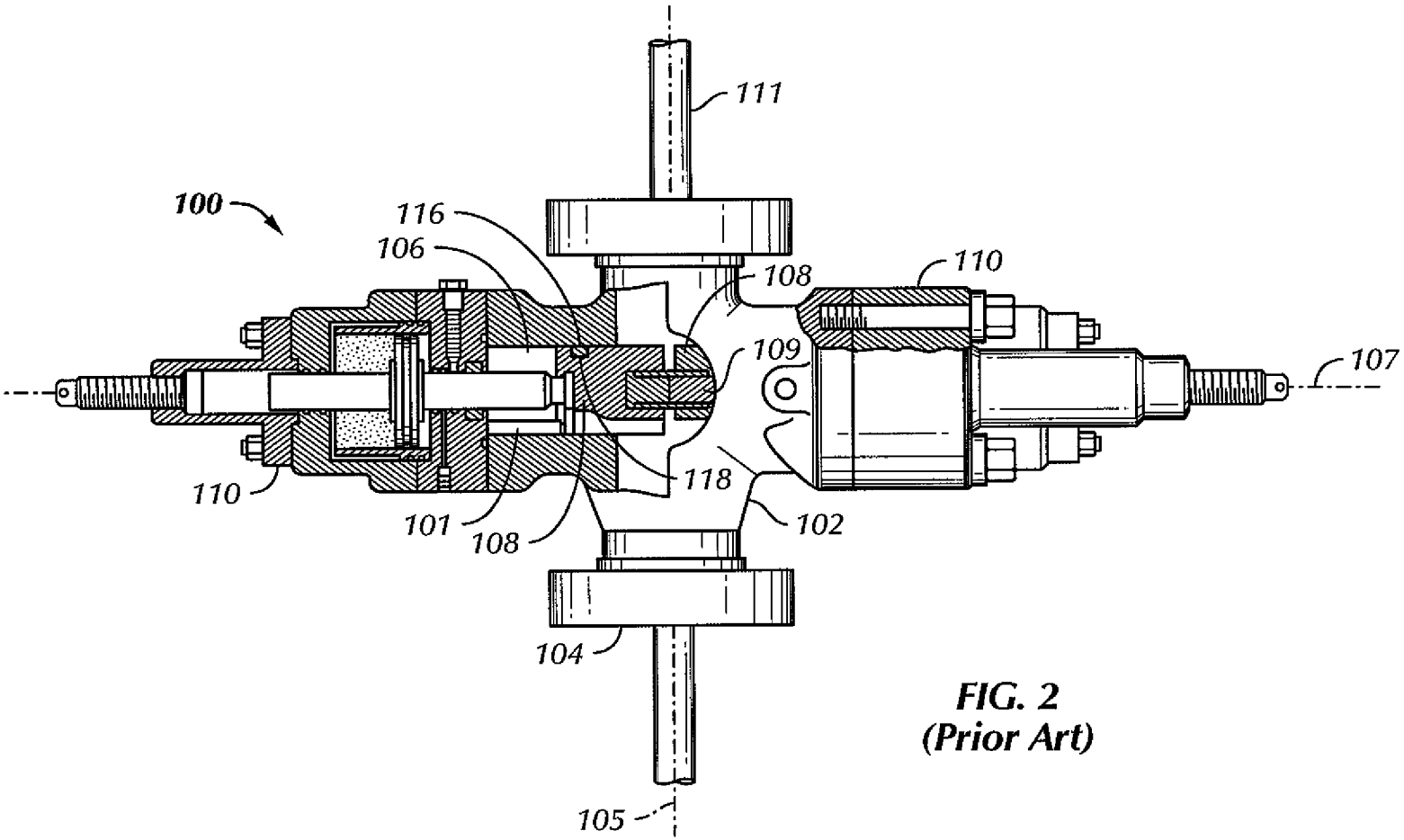
FIG. 2 (Prior Art)
FIG. 2 is a cross-sectional view of a ram-type blowout preventer.
Figure 4A:
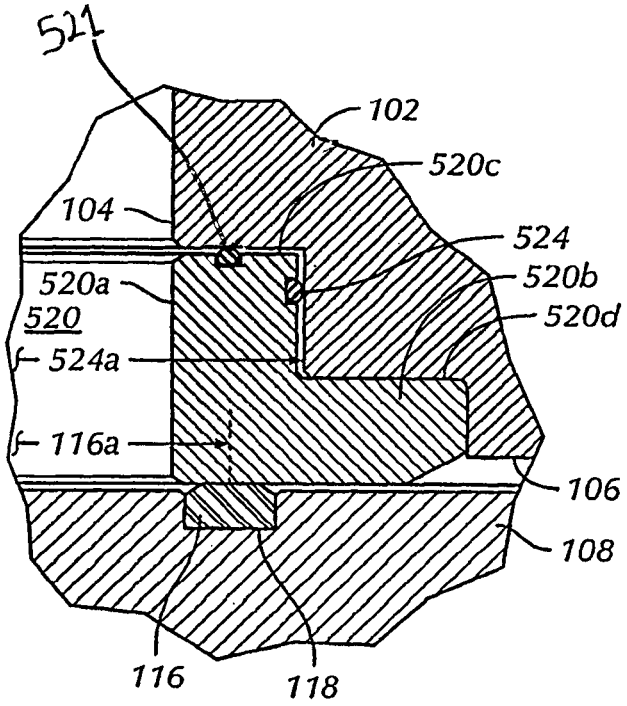
FIG. 4A is a cross-sectional view of a seal carrier for a ram-type blowout preventer in accordance with embodiments disclosed herein.

Referring now to FIG. 4A, a cross-sectioned view of a seal carrier 520 of a ram-type blowout preventer in accordance with embodiments disclosed herein is shown with ram blocks 108 in a "shut-in" position such that they are closed and sealing against wellbore pressure from below. Seal carrier 520 is disposed about vertical bore 104 between housing 102 and horizontal bore 106, located at the intersection of vertical bore 104 and horizontal bore 106. Seal carrier 520 includes a sleeve portion 520A and a flange portion 520B. Furthermore, sleeve portion 520A includes a sleeve top surface 520C and an o-ring seal 524 disposed in a groove 526 on an outer surface of sleeve portion 520A. Flange portion 520B extends radially outward from sleeve portion 520A with respect to wellbore axis 105 (not shown), and has flange top surface 520D. Ram block 108 is shown in a "closed" position, that is, fully displaced into the vertical bore 104 such that the front seals (e.g., 109 of FIG. 2) are in sealing engagement.

Figure 3:
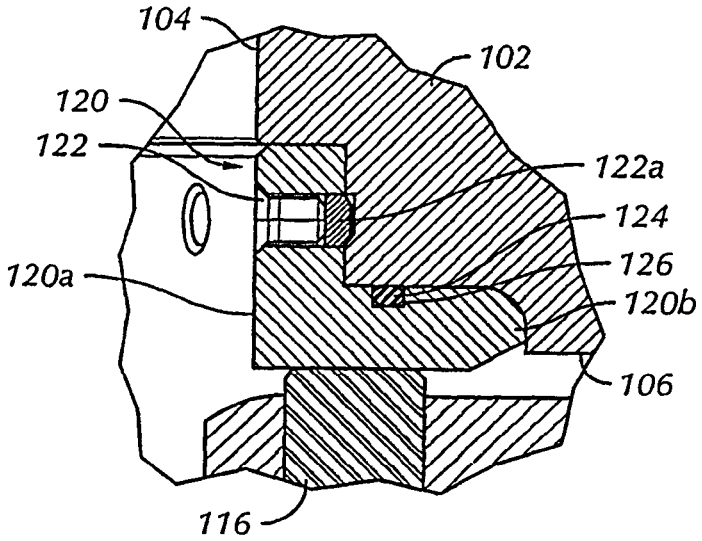
FIG. 3 (Prior Art)
FIG. 3 is a cross-sectional view of a top seal plate for a ram-type blowout preventer available in the prior art.

Furthermore, as shown, seal carrier 520 is radially constrained by BOP body 102, but is free to move vertically within a prescribed range during operation of the ram BOP. In contrast, top seal wear plate 120 shown in FIG. 3 is constrained and prohibited from having any axial movement by bolts 122 and collet-type inserts 122A. Therefore, if ram blocks 108 are in a closed BOP position (as shown in FIG. 4A), the upward travel of seal carrier 520 may be limited to preserve an effective seal by top seal 116. As shown, upward travel may be limited by contact between flange top surface 520D and body 102. Similarly, lower travel, may be limited by the ram blocks themselves, or by other retaining methods known in the art. In any case, and at all positions of seal carrier 520, surface 520C must remain in fluid communication with the vertical bore 104 above the ram blocks 108.

Referring still to FIG. 4A, o-ring 524 may be characterized by an o-ring seal area 524A, measured in a horizontal plane. Similarly, when the ram blocks are "closed" and front seals 109 are in sealing engagement, top seal 116 may be characterized by a top seal area 116A, also measured in a horizontal plane. Those skilled in the art will recognize that while the effective o-ring seal area 524A may be substantially circular, the effective top seal area 116A may not be substantially circular. However, one of ordinary skill in the art will recognize that an average diameter of top seal area 116A may be less than an average diameter of the o-ring seal area 524A.

Further, those having ordinary skill in the art will recognize that while only a single o-ring seal is 524 shown in FIG. 4A, other seal arrangements may be employed on seal carrier 520 without departing from the scope of the current invention. In one selected embodiment, seal carrier 520 may include additional o-rings disposed between the housing of the ram-type blowout preventer and the seal carrier. For example, an o-ring in a groove may be provided on the flange portion 520B of seal carrier 520. Alternatively, other sealing devices may be used in conjunction with seal carrier 520 in place of o-rings. Particularly, seal assemblies having molded rubber adhered to seal carrier 520 and lip-type seals, may be used. Furthermore, in other embodiments, "trash seals" 521 may be provided adjacent seal carrier 520 on BOP body 102 within bore 104 to prevent any debris (e.g., grit, gravel, stones, pebble, dirt, sand) from invading the space between seal carrier 520 and BOP body 102.

Figure 4B:
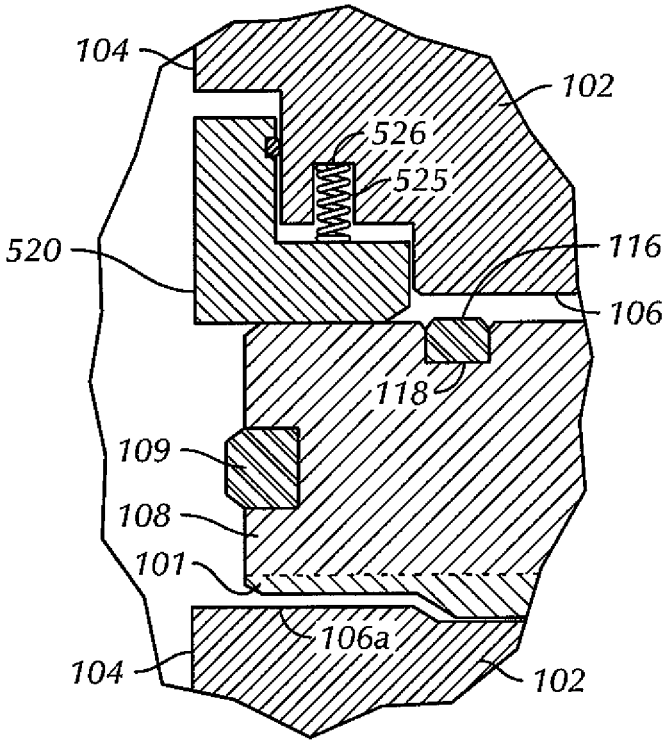
FIG. 4B is a cross-sectional view of a alternative seal carrier for a ram-type blowout preventer in accordance with embodiments disclosed herein.

Referring now to FIG. 4B, an alternative seal carrier 520 at an intersection between vertical bore 104 and horizontal bore 106 on one side of a ram-type BOP is shown. As shown in FIG. 4B, ram block 108 is depicted in a fully-retracted ("open") position with a ledge 106A on the lower surface of horizontal bore 106 and a corresponding recess in ram block 108. When ram block 108 is retracted into horizontal bore 106 (i.e., when vertical bore 104 is fully open), it drops-down off of ledge 106A, relieving pressure on top seal 116 and prolonging seal life. Those skilled in the art will recognize that ledge 106 may be an integral part of BOP body 102, or a separately renewable part.

In the embodiment shown in FIG. 4B, seal carrier 520 is biased downward by at least one spring 525 disposed in a spring recess 526 of BOP body 102. Spring recesses 526 may be arranged radially about a vertical axis (not shown) such that a downward biasing force may be evenly applied to seal carrier 520. As would be understood by those of ordinary skill, other mechanical biasing mechanisms (e.g., an elastomeric ring disposed in a circumferential groove) may be used as well. In this embodiment, seal carrier 520 is restricted from further downward movement by ram block 108.

Furthermore, it should be noted that that in the embodiment shown in FIG. 4B, ram block 108 may include a pressure equalization path in the form of a groove 101 (or "mud slot") machined into the bottom surface of ram block 108 to allow pressure communication between a portion of vertical bore 104 located below the front seals 109 and a volume of the horizontal bore 106 behind the ram block (not shown).

Figure 4C:
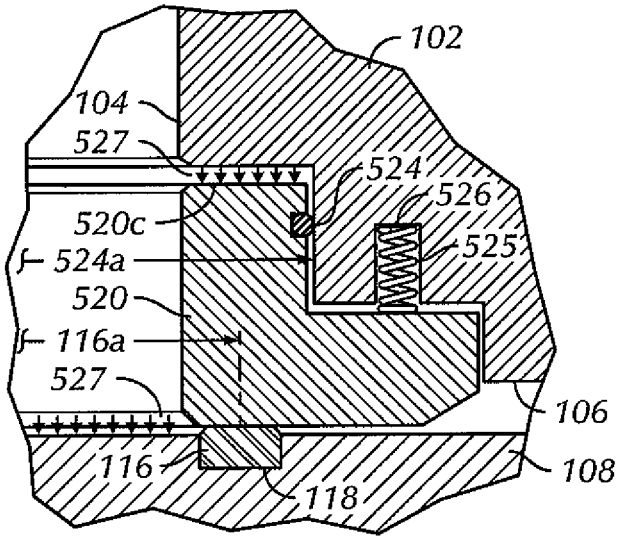
FIG. 4C is a cross-sectional view of the seal carrier of FIG. 4B shown in a pressurized condition.

Referring now to FIG. 4C, a cross-sectional view of seal carrier 520 of FIG. 4B is shown with ram blocks 108 in a closed testing position. In the testing position, ram blocks 108 seal against wellbore pressure from above. As shown, wellbore pressure 527 acts downward upon a top surface of ram blocks 108 and causing ram blocks 108 to move down slightly. Because sleeve top surface 520C is in fluid communication with vertical bore 104, wellbore pressure also acts to thrust seal carrier 520 in a downward direction. As well bore is sealed off by front seals (e.g., 109 of FIG. 2), a seal is created between ram block 108 and the seal carrier 520 through top seal 116, and a seal is created between seal carrier 520 and body 102 through o-ring 524. Therefore, the net force pushing seal carrier downwards into contact with top seal 116 may be calculated as:

$$\text{Force}=(O_A-T_A)\times WBP; \quad \text{(Eq. 1)}$$

where $O_A$ is the o-ring seal area 524A, $T_A$ is the top seal area 116A, and WBP is the wellbore pressure 527.

Furthermore, if seal carrier 520 is mechanically biased downwards (as shown with springs 525), the net force may also comprise the total downward force of biasing springs 525. In selected embodiments, the o-ring seal area 524A may exceed top seal area 116A by 5% to insure adequate sealing at test pressure. In other embodiments, the differential between the sealing areas may be greater than 10%.

Figure 4D:
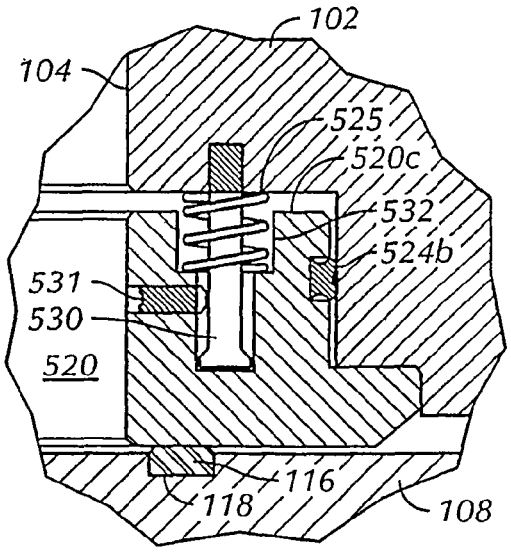
FIG. 4D is a cross-sectional view of a second alternative seal carrier for a ram-type blowout preventer in accordance with embodiments disclosed herein.

Referring now to FIG. 4D, an alternative seal carrier 520 for a ram-type blowout preventer is shown engaged by ram blocks 108 in a closed sealing against wellbore pressure from below. As shown, seal carrier 520 includes a lip seal 524B in lieu of o-ring seal 524 of FIGS. 4A-4C, and a plurality of screws 530 to limit the downward travel of the seal carrier 520. Screws (e.g., Allen-head cap screws) 530 may be threaded into BOP body 102 in a radial pattern opposite sleeve top surface 520C. As shown, seal carrier 520 includes stepped holes 532 to accommodate screws 530 with springs 525 installed concentrically around them.

Furthermore, a plurality of set-screws 531 may be installed radially in seal carrier 520. Thus, the lower limit of the downward travel of seal carrier 520 may be determined by the relative vertical positions of setscrews 531 and the heads of screws 530. Downward mechanical bias is provided by springs 525, which are shown as coil springs, but which may be any appropriate device which generates a spring-force, such as Bellville washers or an elastomeric springs. In one embodiment, the biasing spring force may be provided by a thick resilient gasket between sleeve top surface 520C and BOP body 102 with provision for screws 530 to pass therethrough. Advantageously, such a gasket may serve both as a biasing spring and as a trash seal.

Figure 5:
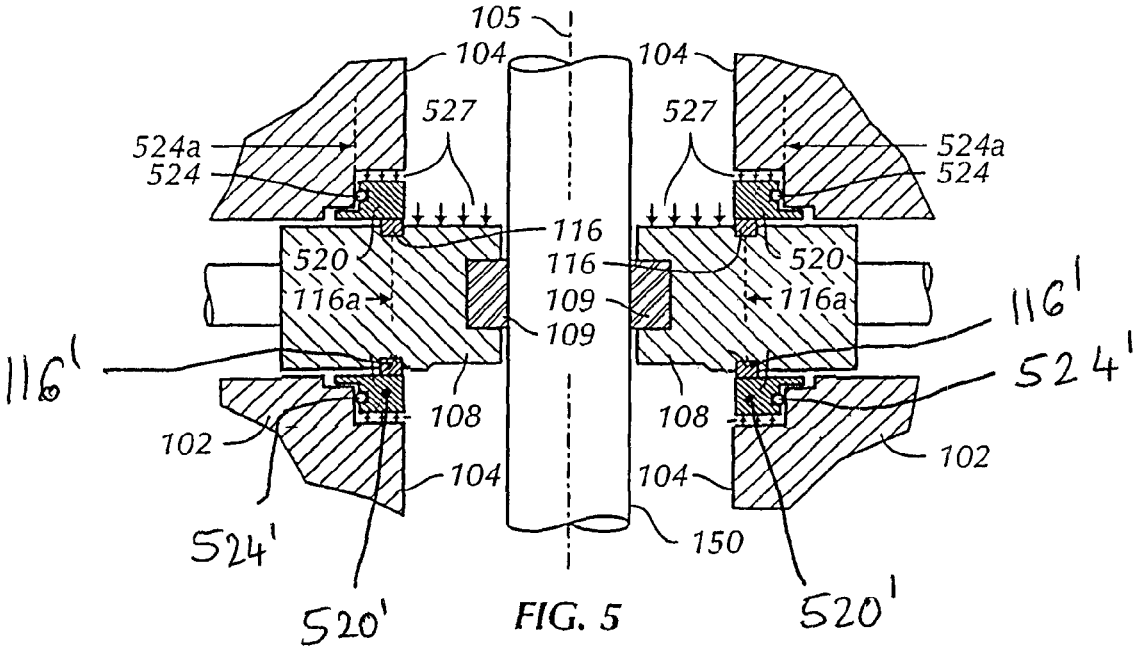
FIG. 5 is a cross-sectional view of a seal carrier and ram blocks of a ram-type blowout preventer providing sealing engagement about a drill pipe in accordance with embodiments disclosed herein.

Referring now to FIG. 5, a cross-sectional view of the intersection of vertical bore 104 and horizontal bore 106 on both sides of a ram-type BOP with rain blocks 108 in a fully-extended ("closed") position, in "testing" mode with wellbore pressure 527 applied from above. As previously discussed, front seals 109 and top seals 116 are sealingly connected such that together, they seal off the vertical bore 104 completely when the ram BOP is closed. The extents of o-ring seal area 524A and top seal area 116A may be discerned as described above in reference to FIGS. 4A and 4C.

Still referring to FIG. 5, an alternative seal carrier 520'is shown positioned below an axis of the horizontal bore 106. The seal carrier 520'and the structure of the body 102 of the blowout preventer shown in FIG.5 are similar to those shown in FIGS. 4A and B except for the positioning of the seal carrier 520',i.e., the seal carrier 520'includes a sealing device 524'and the seal carrier 520'sealingly engages a bottom seal 524'of the ram block 108.

Those having ordinary skill in the art will appreciate that, although seal carrier 520 is shown positioned above a central axis of horizontal bore 106 in FIGS. 4A-4D and FIG. 5, the present disclosure should not be so limited. Particularly, in selected embodiments, the seal carrier may be positioned below the horizontal axis such that the seal carrier may be thrust into sealing engagement with the ram blocks by high-pressure fluids from below.

Advantageously, a ram-type BOP fitted with a seal carrier in accordance with embodiments disclosed herein may seal against bi-directional pressure using only the existing top seals and front seals and one additional inexpensive seal behind the seal carrier. Furthermore, such a BOP may seal against such bidirectional pressure without expensive, troublesome, and complicated pressure-biasing mechanisms and methods. Further, seal carriers in accordance with the embodiments disclosed herein may be easily and inexpensively retrofitted to existing ram BOPs, thus allowing older BOP stacks to be tested in situ on the seabed inexpensively and quickly, and without dedicating a BOP "cavity" to testing.

While the invention has been described with respect to a limited number of embodiments, those skilled in the art, having benefit of this disclosure, will appreciate that other embodiments may be devised which do not depart from the scope of the invention as disclosed herein. Accordingly, the scope of the invention should be limited only by the attached claims.

What is claimed is:

1. A ram-type blowout preventer, comprising:

a body;

a vertical bore through the body;

a horizontal bore through the body intersecting the vertical bore;

a pair of ram blocks disposed in the horizontal bore on opposite sides of the body, wherein the ram blocks are configured to move along the horizontal bore to have controlled lateral movement to and from the vertical bore;

a seal carrier disposed about the vertical bore between the body and adjacent to the horizontal bore; and a sealing device positioned between the body and the seal carrier;

wherein the seal carrier is configured to be displaced along an axis of the vertical bore such that the seal carrier moves unbiased within a predetermined range along the vertical bore, and the sealing device is positioned further away from the axis of the vertical bore than a top seal of the at least one of the pair of ram blocks such that when a pressure from above the pair of ram blocks is applied, a net force is generated that pushes the seal carrier towards the pair of ram blocks.

2. The ram-type blowout preventer of claim 1, wherein the seal carrier is configured to sealingly engage a top seal of at least one of the pair of ram blocks and the seal carrier has a sleeve portion and a flange portion, the flange portion being configured to limit a travel of the seal carrier along the vertical bore by contacting the body.

3. The ram-type blowout preventer of claim 2, wherein a pressure seal area of the seal carrier is larger than a pressure seal area of the ram.

4. The ram-type blowout preventer of claim 1, wherein the seal carrier comprises a sleeve portion and a flange portion.

5. The ram-type blowout preventer of claim 4, wherein the sealing device is disposed upon the sleeve portion.

6. The ram-type blowout preventer of claim 1, wherein the sealing device comprises at least one of an o-ring and molded rubber.

7. The ram-type blowout preventer of claim 1, wherein the seal carrier is positioned above an axis of the horizontal bore.

8. The ram-type blowout preventer of claim 1, wherein the seal carrier is positioned below an axis of the horizontal bore.

9. The ram-type blowout preventer of claim 1, wherein the body comprises:

a recess portion configured to accommodate the seal carrier, the recess portion having a shoulder that prevents the seal carrier to move more than a predetermined distance upwards along the axis of the vertical bore, wherein, if an upper pressure is applied from above the pair of ram blocks in the vertical bore, the upper pressure determines the seal carrier to move downwards along the axis of the vertical bore towards the pair of ram blocks to sealingly engage the top seal of at least one of the pair of ram blocks, if a lower pressure is applied from below the pair of ram blocks in the vertical bore, the lower pressure determines the pair of ram blocks to move upwards along the axis of the vertical bore towards the seal carrier to sealingly engage the top seal with the seal carrier while the seal carrier is stopped from moving upwards by the shoulder of the recess portion, and thus the seal carrier sealingly engages the top seal of the at least one of the pair of ram blocks either when the upper pressure is applied to the blowout preventer or when the lower pressure is applied to the blowout preventer such that the blowout preventer is operational in a dual-direction.

10. A ram-type blowout preventer, comprising:

a body;

a vertical bore through the body;

a horizontal bore through the body intersecting the vertical bore;

a pair of ram blocks disposed in the horizontal bore on opposite sides of the body, wherein the ram blocks are configured along the horizontal bore to have controlled lateral movement to and from the vertical bore;

a seal carrier disposed at the intersection of the vertical bore and the horizontal bore; and a sealing device positioned between the body and the seal carrier;

wherein the seal carrier is configured to be displaced along an axis of the vertical bore such as that the seal carrier moves unbiased within a predetermined range along the vertical bore, wherein the seal carrier is configured to be sealingly engaged with a top seal of at least one of the pair of ram blocks, and the sealing device is positioned further away from the axis of the vertical bore than a top seal of the at least one of the pair of ram blocks such that when a pressure from above the pair of ram blocks is applied, a net force is generated that pushes the Seal carrier towards the pair of ram blocks

11. The ram-type blowout preventer of claim 10, wherein a pressure seal area of the seal carrier is larger than a pressure seal area of the ram blocks.

12. The ram-type blowout preventer of claim 10, wherein the seal carrier comprises a sleeve portion and a flange portion and the sealing device is disposed upon the sleeve portion.

13. A ram-type blowout preventer, comprising:

a body;

a vertical bore through the body;

a horizontal bore through the body intersecting the vertical bore;

a pair of ram blocks disposed in the horizontal bore on opposite sides of the body, wherein the ram blocks are configured to move along the horizontal bore to have controlled lateral movement to and from the vertical bore;

a seal carrier disposed at the intersection of the vertical bore and the horizontal bore; and a sealing device positioned between the body and the seal carrier;

wherein the seal carrier is configured to be thrust into sealing engagement with at least one of the pair of ram blocks by fluid pressure above the ram blocks such that the seal carrier moves unbiased within a predetermined range along the vertical bore, and the sealing device is positioned further away from an axis of the vertical bore than a top seal of at least one of the pair of ram blocks such that when the fluid pressure from the pair of ram blocks is applied, a net force is generated that pushes the seal carrier towards the pair of ram blocks.

14. The ram-type blowout preventer of claim 13, wherein the seal carrier is configured to be thrust into sealing engagement with a top seal of the at least one of the pair of ram blocks.

15. The ram-type blowout preventer of claim 13, wherein a pressure seal area of the seal carrier is larger than a pressure seal area of the ram blocks.

16. The ram-type blowout preventer of claim 13, wherein the seal carrier comprises a sleeve portion and a flange portion, and the sealing device is disposed upon the sleeve portion.

17. A method of actuating a ram-type blowout preventer, the method comprising:

positioning a sealing device further away from an axis of a vertical bore of a body of the blowout preventer than a top seal of at least one of a pair of ram blocks such that when a pressure from above the pair of ram blocks is applied, a net force is generated that pushes a seal carrier towards the pair of ram blocks, wherein the seal carrier is configured to move unbiased within a predetermined range along the vertical bore;

sealing a pair of ram blocks against one another proximate a wellbore axis by moving the pair of ram blocks along a horizontal bore formed in a body of the ram-type blowout preventer; and sealingly engaging a seal carrier with at least one of the pair of ram blocks from fluid pressure acting upon the ram blocks, wherein the seal carrier is configured to be sealingly displaced along the wellbore axis such that the seal carrier moves along the vertical bore formed in a body of the ram-type blowout preventer, the vertical bore intersecting the horizontal bore.

18. The method of claim 17, further comprising:

sealingly engaging the seal carrier with the top of the at least one of the pair of ram blocks when an upper pressure is applied from above the pair of ram blocks in the vertical bore, the upper pressure determining the seal carrier to move downwards along an axis of the vertical bore towards the pair of ram blocks to sealingly engage the top seal of at least one of the pair of ram blocks, determining the pair of ram blocks to move upwards, if a lower pressure is applied from below the pair of ram blocks in the vertical bore, along the axis of the vertical bore towards the seal carrier to sealingly engage the top seal with the seal carrier while the seal carrier is stopped from moving upwards by a shoulder of a recess portion of the body, and thus sealingly engaging the seal carrier with the top seal of the at least one of the pair of ram blocks either when the upper pressure is applied to the blowout preventer or when the lower pressure is applied to the blowout preventer such that the blowout preventer is operational in a dual-direction.

19. The method of claim 17, wherein a pressure seal area of the seal carrier is larger than a pressure seal area of the ram blocks.

* * * * *